US008944270B2

(12) United States Patent
Bontrager et al.

(10) Patent No.: US 8,944,270 B2
(45) Date of Patent: Feb. 3, 2015

(54) CONTAINER WITH IMPROVED TAMPER EVIDENT STRUCTURE

(75) Inventors: Richard Louis Bontrager, Manteca, CA (US); Randall Glenn Strange, Manteca, CA (US)

(73) Assignee: Natural Selection Foods, LLC, San Juan Bautista, CA (US)

( * ) Notice: Subject to any disclaimer, the term of this patent is extended or adjusted under 35 U.S.C. 154(b) by 520 days.

(21) Appl. No.: 12/885,362

(22) Filed: Sep. 17, 2010

(65) Prior Publication Data

US 2012/0067009 A1 Mar. 22, 2012

(51) Int. Cl.

| | |
|---|---|
| ***B65D 17/34*** | (2006.01) |
| ***B65D 43/02*** | (2006.01) |
| *B65B 7/28* | (2006.01) |

(52) U.S. Cl.

CPC ..... *B65D 43/0264* (2013.01); *B65D 43/0237* (2013.01); *B65D 2101/0092* (2013.01); *B65B 7/2842* (2013.01)

USPC ..... 220/270; 220/266; 220/359.1

(58) Field of Classification Search

USPC ..... 220/266, 270, 359.4, 780, 4.21, 359.1; 229/242; 215/253, 254, 256

See application file for complete search history.

(56) References Cited

U.S. PATENT DOCUMENTS

| | | | | |
|---|---|---|---|---|
| 3,300,115 | A * | 1/1967 | Schauer | 221/305 |
| 4,759,463 | A * | 7/1988 | Mazoin | 220/270 |
| 6,554,147 | B1 | 4/2003 | Maida, Jr. et al. | |
| 6,659,296 | B2 | 12/2003 | Browne | |
| D501,403 | S | 2/2005 | Wilcock et al. | |
| D502,096 | S | 2/2005 | Wilcock et al. | |
| D504,281 | S | 4/2005 | Duggan | |
| 6,941,726 | B2 | 9/2005 | Ausnit | |
| 7,002,472 | B2 | 2/2006 | Stratmoen et al. | |
| 7,073,308 | B2 | 7/2006 | Dyke et al. | |
| 7,114,309 | B2 | 10/2006 | Ausnit | |
| 7,118,003 | B2 | 10/2006 | Sellari et al. | |
| 7,174,277 | B2 | 2/2007 | Vock et al. | |
| 7,185,475 | B2 | 3/2007 | Ausnit | |
| 7,267,856 | B2 | 9/2007 | Patel et al. | |
| 7,302,782 | B2 | 12/2007 | Ausnit | |
| 7,316,641 | B2 | 1/2008 | Rehwinkel et al. | |
| 7,472,799 | B2 | 1/2009 | Cadiente et al. | |
| D585,735 | S | 2/2009 | Vovan et al. | |
| D587,993 | S | 3/2009 | Vovan | |
| 7,537,386 | B2 | 5/2009 | Linton et al. | |
| 7,568,589 | B2 | 8/2009 | Vovan | |
| 7,631,776 | B2 | 12/2009 | Vovan et al. | |
| 7,634,892 | B2 | 12/2009 | Ausnit | |
| 7,669,307 | B2 | 3/2010 | Patel et al. | |
| 7,712,626 | B2 | 5/2010 | Vovan | |
| 7,762,414 | B2 | 7/2010 | Uytterhaeghe et al. | |
| 2008/0308557 | A1 * | 12/2008 | Kyle et al. | 220/359.1 |
| 2010/0113241 | A1 * | 5/2010 | Hebert et al. | 493/213 |

* cited by examiner

*Primary Examiner* — Jeffrey Allen
(74) *Attorney, Agent, or Firm* — Meyer IP Law Group

(57) ABSTRACT

A container includes a basket and lid. The basket and lid each have a lip along at least a portion of a periphery and a tear strip connected along at least a portion of the lip. An outer edge of the lip includes notches and an inner edge of the tear strip complements the outer edge of the lip. The tear strip is connected to the lip by links arranged at notches of the outer edge of the lip. The basket tear strip is bonded to the lid tear strip to resist separation of the lid from the basket. The bonded basket tear strip and lid tear strip are detachable from the basket lip and the lid lip urged away from the basket and the lid, exposing the outer edge of the basket lip and the outer edge of the lid lip.

18 Claims, 8 Drawing Sheets

CONTAINER WITH IMPROVED TAMPER EVIDENT STRUCTURE

TECHNICAL FIELD

This invention relates generally to packaging, and more particularly to packaging for fragile and/or perishable goods.

BACKGROUND

Plastic containers for holding perishable goods are ubiquitous in grocery stores and produce markets and can be found by consumers in a variety of shapes and sizes. For example, berries are sold in clear polyethylene terephthalate (PETE) clamshell containers holding anywhere from a half-pint to a quart or more of fruit. Such plastic containers can be opened by consumers at the point of sale and the goods contained within may be handled by multiple different people before purchase, leading to bruising and contamination that can degrade the quality of the goods. Consumers would generally prefer that the goods be inaccessible until purchased.

DETAILED DESCRIPTION OF THE DRAWINGS

Figure 1:
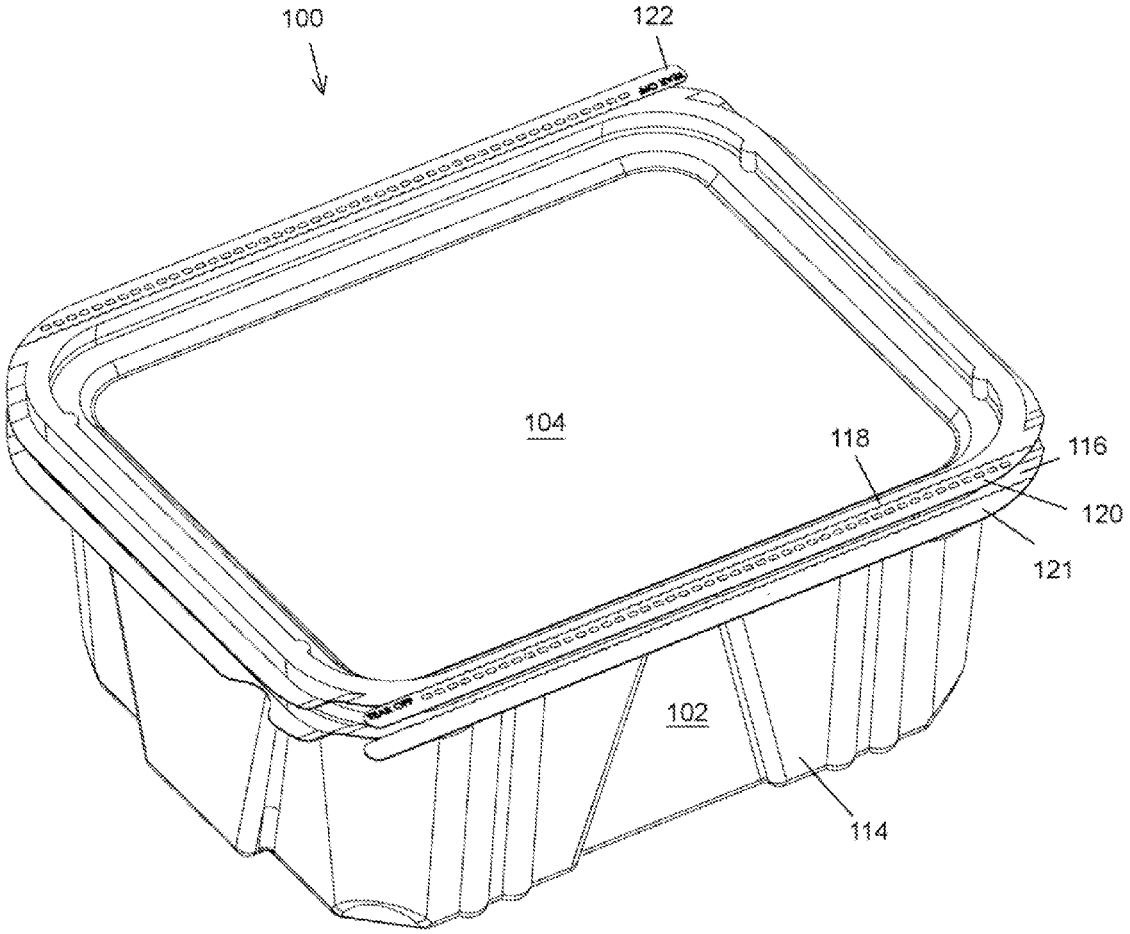
FIG. 1 is a perspective view of an embodiment of a container in accordance with the present invention.

Referring to FIG. 1, an embodiment of a container 100 in accordance with the present invention is shown. The container 100 comprises a basket 102 defined at least partially by a base (105 in FIGS. 3A and 3B) and a sidewall 114 extending from the base 105 to a basket lip 116. The base 105 can be concave, flat, or alternatively can have some other shape relative to a plane on which the basket 102 can rest, depending on a desired contact surface area, a desired flow of air along the base 105, etc. Optionally the base 105 can include one or more perforations, the one or more perforations permitting drainage, ventilation, ornamentation, or some other purpose. As shown, the base 105 has an approximately rectangular footprint across the plane on which it rests. The sidewall 114 extending from the base 105 has four faces. Alternatively, in other embodiments the footprint of the base 105 can be some other shape, such as square, triangular or circular, for example.

The container 100 further comprises a lid 104 that can be separated from the basket 102 to access goods within the basket 102. However, the lid 104 is fixedly mated with the basket 102 during shipping, and/or while offered for sale to consumers. Preferably, at least a portion of the container 100 is formed from transparent or semi-transparent polymer material so that a consumer can inspect goods within the container 100 without the need to access the inside of the basket 102. The lid 104 is fixedly mated with the basket 102 by two sets of paired tear strips that extend along the length of the container 100. A basket tear strip 121 connected with the basket lip 116 is bonded to a lid tear strip 120, 122 connected with a lid lip 118. The tear strips must be detached from the lid 104 and the basket 102 to separate the lid 104 from the basket and access goods within the basket 102. The tear strips protect the goods within the container 100 from damage and/or contamination, and provide tamper evidence to consumers.

Figure 2A:
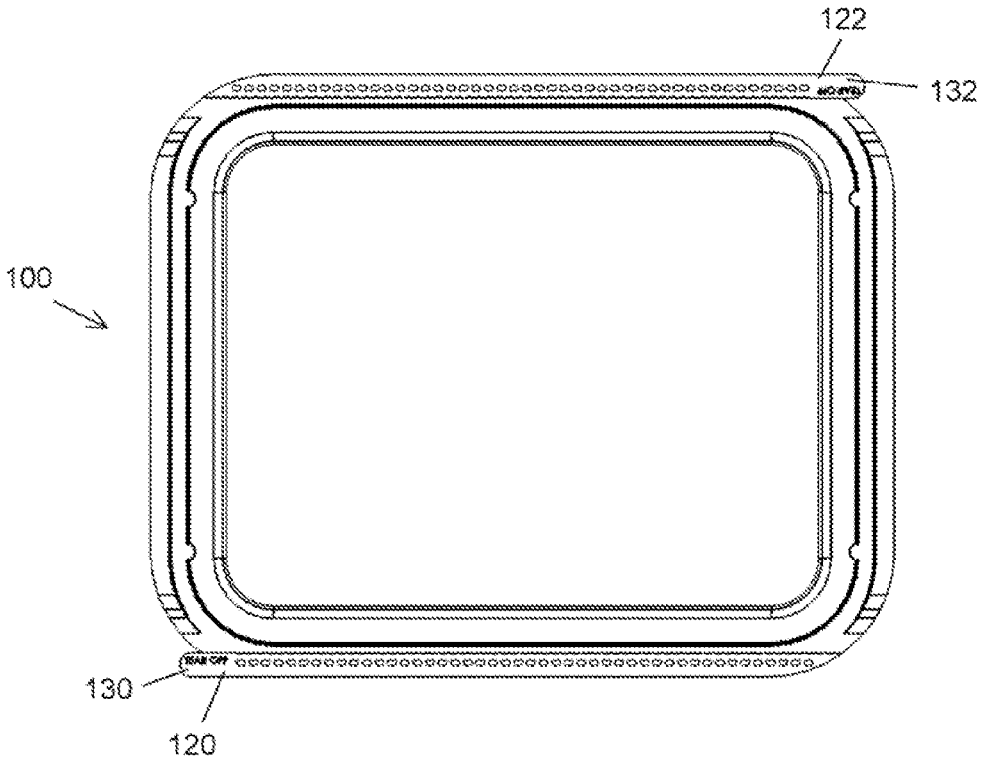
FIG. 2A is a top view of the container of FIG. 1.
Figure 2B:
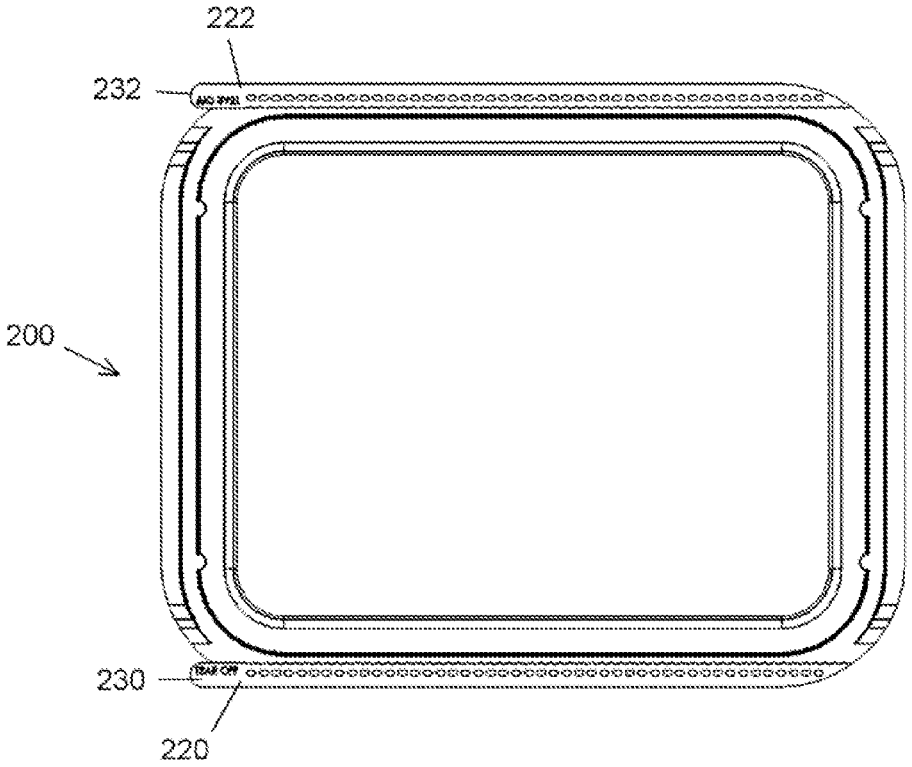
FIG. 2B is a top view of an alternative embodiment of a container in accordance with the present invention.
Figure 2C:
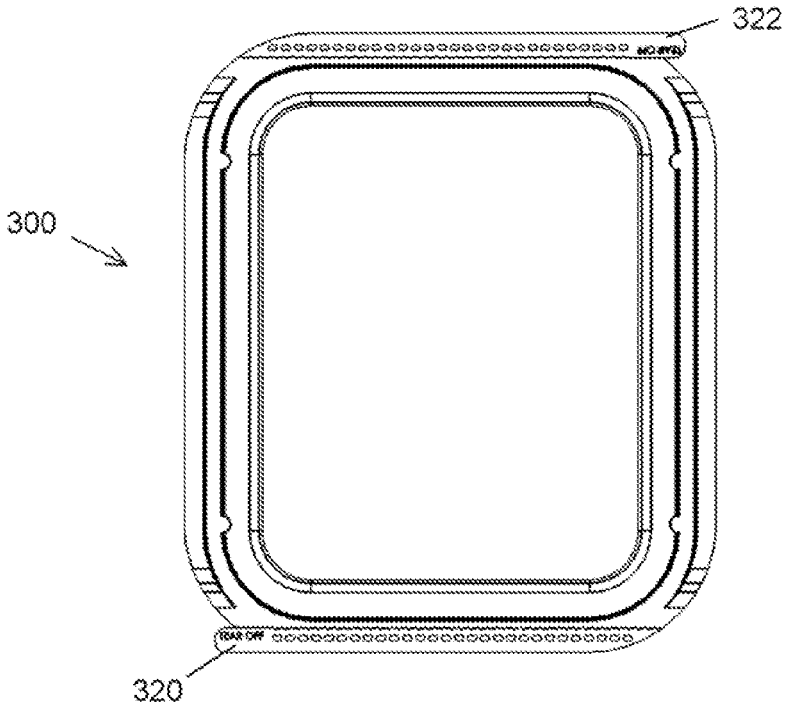
FIG. 2C is a top view of a further embodiment of a container in accordance with the present invention having a hinge.
Figure 2D:
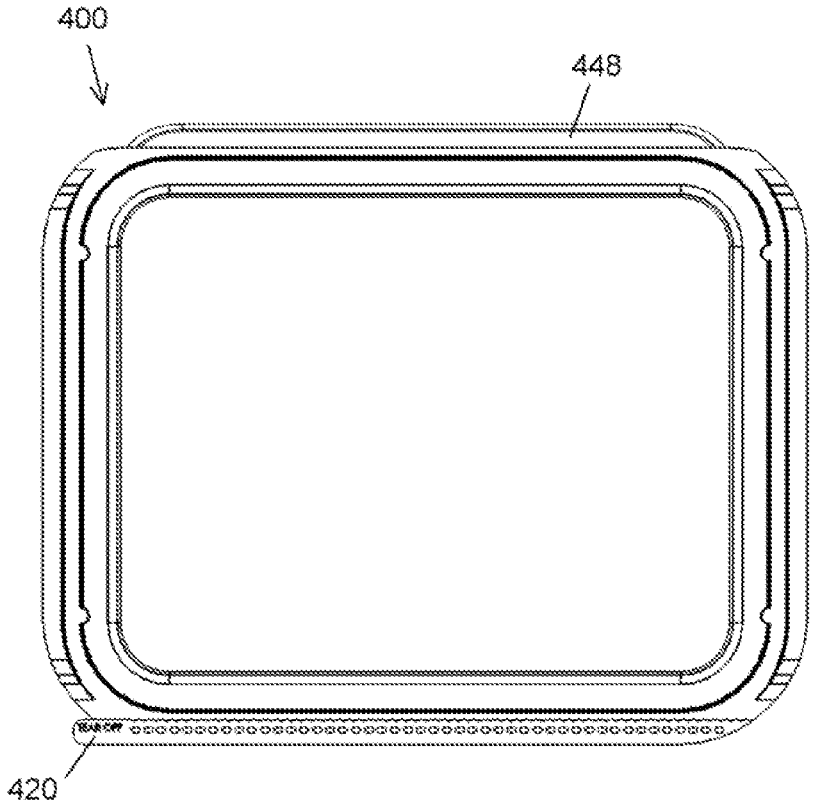
FIG. 2D is a top view of a further embodiment of a container in accordance with the present invention having a hinge.
Figure 2E:
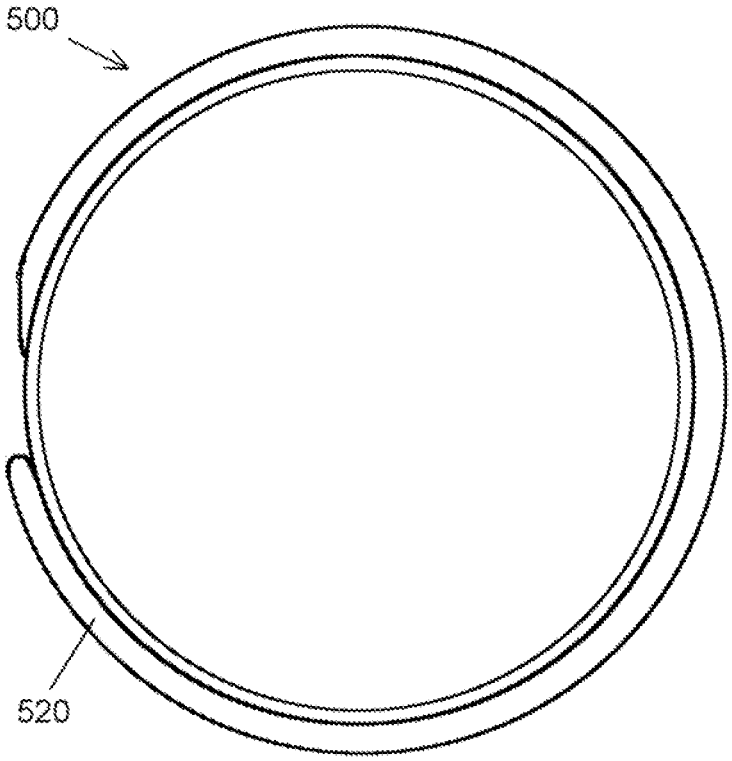
FIG. 2E is a top view of a further embodiment of a container in accordance with the present invention having a circular lid.

As shown in FIGS. 1 and 2A, the sets of tear strips 120, 122 extend along opposite sides of the container in opposite directions so that tabs 130, 132 graspable for detaching the tear strips 120, 122 from the container 100 extend from opposite ends of the container 100. However, as will be appreciated by one of ordinary skill in the art upon reflecting on the teachings contained herein, the tear strips 120, 122 need not be arranged as shown in FIGS. 1 and 2A. For example, in the embodiment shown in FIG. 2B, the tear strips 220, 222 include tabs 230, 232 that extend from the same end of the container 200. In a further embodiment shown in FIG. 2C, the tear strips 320, 322 extend along the ends of the container 300 rather than the sides of the container 300. In a further embodiment shown in FIG. 2D, the container 400 is a clam-shell with a single tear strip 420 extending along one side of the container 400 and an integrally formed hinge 448 at an opposite side of the container 400. In a still further embodiment shown in FIG. 2E, the container 500 has a round shape and a single tear strip 520 extending around at least a portion of the periphery of the container 500. Myriad different container shapes and arrangements of tear strips can be applied while remaining within the scope of the present invention. The present invention is not intended to be limited to those shapes and tear strip arrangements shown in FIGS. 1-2E.

Figure 3A:
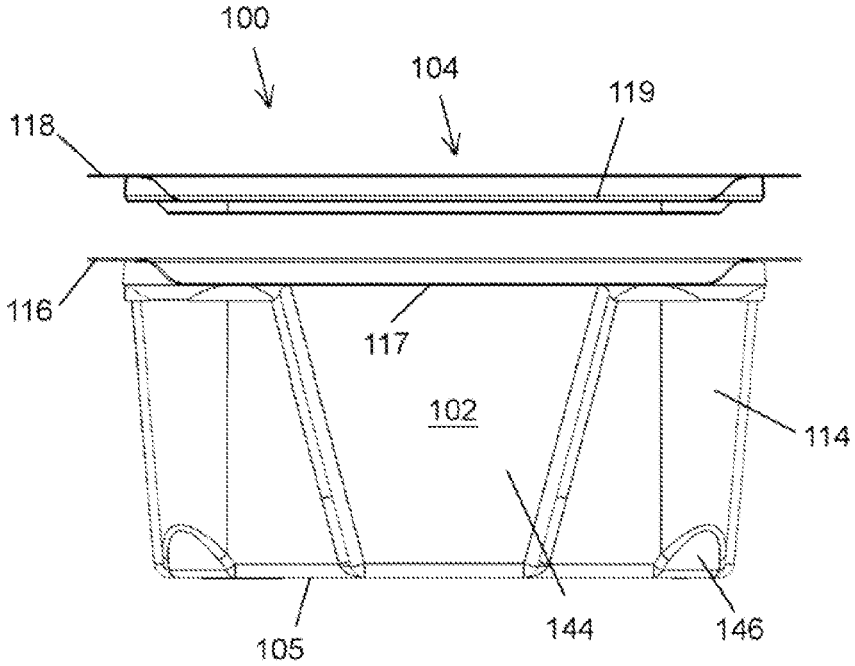
FIG. 3A is an end view of the container of FIG. 1 with a lid of the container separated from a basket of the container.
Figure 3B:
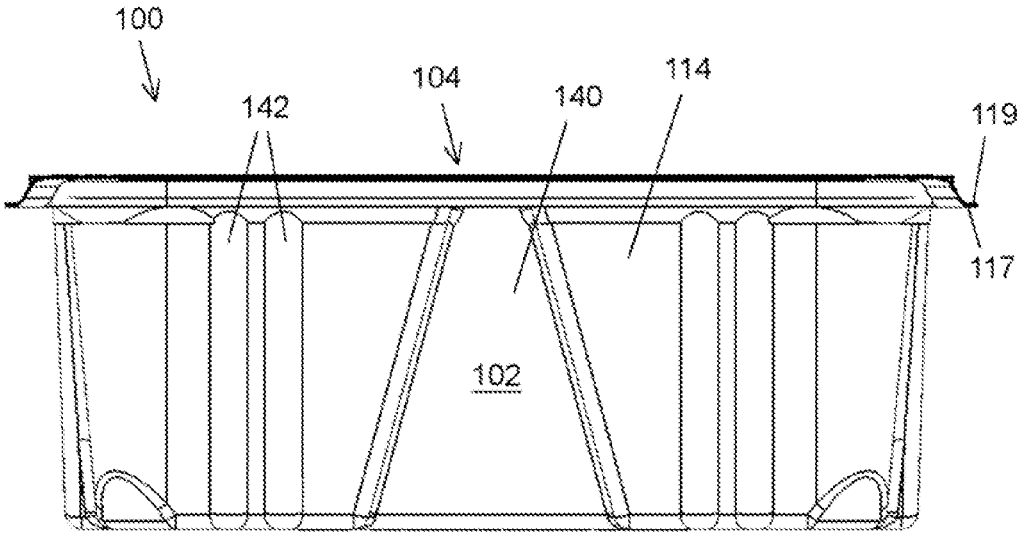
FIG. 3B is a side view of the container of FIG. 1.

Referring to FIGS. 3A and 3B, the sidewall 114 connecting the base 105 with the basket lip 116 has a simple draft that has a slight angle from perpendicular relative to a plane on which the container 100 sits. A draft can assist in ejection or removal of a basket from a mold. Further, the draft can sufficiently reduce a footprint of the base 105 such that the base 105 can be received on the lid of a second container without interference from a lip of the lid (if the lip is made to protrude above the resting surface of the lid). Alternatively, the sidewall 114 can include a compound draft from the basket lip 116 to the base 105. A compound draft includes two or more angles between the base 105 and the basket lip 116. The draft can be varied to suit manufacturing or to selectively adjust a volume of the basket. A sharper draft decreases basket volume, but can aid in manufacturing by easing ejection of the basket from a mold. In other embodiments, the sidewall 114 need not include a draft from the basket lip 116 to the base 105, or can include a compound draft including more than two angles. In still further embodiments, one face of the sidewall 114 can include no draft, or a draft having a different angle when compared with that of another face of the sidewall 114.

The sidewall 114 further includes features integrally formed during the molding process to improve sidewall strength. The end faces of the sidewall 114 include trapezoidal protrusions 144. The trapezoidal protrusions 144 allow the container to be stood on end for display purposes, with the trapezoidal protrusion 144 acting as support for the container 100. The side faces of the sidewall 114 include trapezoidal recessions 140 and arcuate protrusions 142 that resemble pillars. Baskets having integrally formed protrusions and recessions can be referred to as semi-smooth-walled baskets. The recessions 140, and protrusions 142, 144 increase rigidity and strengthen the sidewalls 114 against compressive forces. Increasing compressive sidewall strength allows the container to be formed with a thinner sidewall, thereby reducing manufacturing costs. Alternatively, increasing compressive sidewall strength can allow greater protection to goods within the container and improve stackability of containers. The corners of the sidewall are further strengthened by forming facets 146 extending from the base 105 to the rounded corners of the sidewall. It should be noted that embodiments of containers in accordance with the present invention need not necessary include sidewall features, or the sidewall can include features of different number and shape. For example, embodiments of containers in accordance with the present invention can comprise baskets having smooth sidewalls which are generally featureless. Use of smooth sidewalls reduces the number of contactable edges, but can result in a sidewall having less rigidity when compared with a semi-smooth-walled basket. Sidewall strength can be increased by increasing a thickness of the sidewalls. One of ordinary skill in the art will appreciate the myriad different shapes including or excluding drafts with which the sidewall 114 extending from the base 105 to the basket lip 116 can be formed. Embodiments of baskets in accordance with the present invention are intended to be applied to all such shapes without necessary differentiation.

Referring again to FIG. 3A, the basket lip 116 and lid lip 118 include complementary locking features 117, 119 that allow the lid 104 to be coupled to the basket 102 so that the lid 104 and basket 102 resist separation until sufficient force is applied to uncouple the complementary locking features 117, 119, allowing the container to be opened and reclosed after the tear strips 120, 122 have been detached. However, in other embodiments, the basket lip 116 and lid lip 118 need not include locking features 117, 119. As can be seen in FIG. 1, the basket lip 116 can also include a cut-away 115 allowing the lid lip 118 to be grabbed separately from the basket lip 116 so that the lid 104 can be urged away from the basket 102.

FIGS. 4A-4D illustrate a tear strip scheme for use with embodiments of a container in accordance with the present invention. The basket tear strip 121 is connected with the basket lip 116 by a plurality of basket links 124 and the lid tear strip 120 is connected with the lid lip 118 by a plurality of lid links 126. The outer edges of the basket lip 116 and lid lip 118 are undulated so that they resemble waves. The outer edges of the basket tear strip 121 and lid tear strip 120 complement the outer edges of the basket lip 116 and lid lip 118 so that the outer edges extend substantially parallel to each other along the length of the container. The links 124, 126 are arranged within notches 116*a*, 118*a*, or indentations of the outer edges of the lips 116, 118. These notches are arranged between protrusions 116*b*, 118*b* of the outer edges of the lips 116, 118. As shown, the notches 116*a*, 118*a* of the undulated outer edges are rounded indentations and the protrusions 116*b*, 118*b* of the undulated edges are rounded protrusions. When the links 124, 126 are severed, the tear strips 120, 121 are detached from the lips 116, 118, exposing the outer surface of the lips 116, 118. Chaff 134, 136 (also referred to herein as remainders) from the disconnected links remains connected to the lip 116, 118; however, the chaff 134, 136 does not extend beyond the protrusions 116*b*, 118*b* of the outer edges of the lips 116, 118. The protrusions 116*b*, 118*b* are formed sufficiently close together that a finger or thumb, for example, brushed against the exposed outer edge of the lip 116, 118 likely is not impeded by the chaff 134, 136, making the outer edge feel relatively smoother when compared with a straight edge. This arrangement can reduce the risk of cuts to fingers or thumbs while providing a technique for unsealing the container with low force.

While the outer edges of the basket lip 116 and lid lip 118 are shown in FIGS. 4A-4D having an undulating shape resembling waves, in other embodiments, the outer edges can have some other shape. The outer edges of the basket lip and lid lip need only have a shape with alternating protruding and receding features. Thus, for example, in some embodiments, the outer edges of the basket lip and lid lip can be scalloped so that a series of rounded protrusions alternate with notches formed by deep grooves, with the links extending from the grooves. In still other embodiments, the outer edges of the basket lip and lid lip can include L-shaped features with links beings connected within the L-shaped features. One of ordinary skill in the art, upon reflecting on the teaches provided herein, will appreciate the myriad different shapes which the outer edges of the basket lip and lid lip can have to reduce contact with chaff formed when detaching a tear strip from a lip. The present invention is not intended to be limited to the forms shown in FIGS. 4A-4D.

Figure 4A:
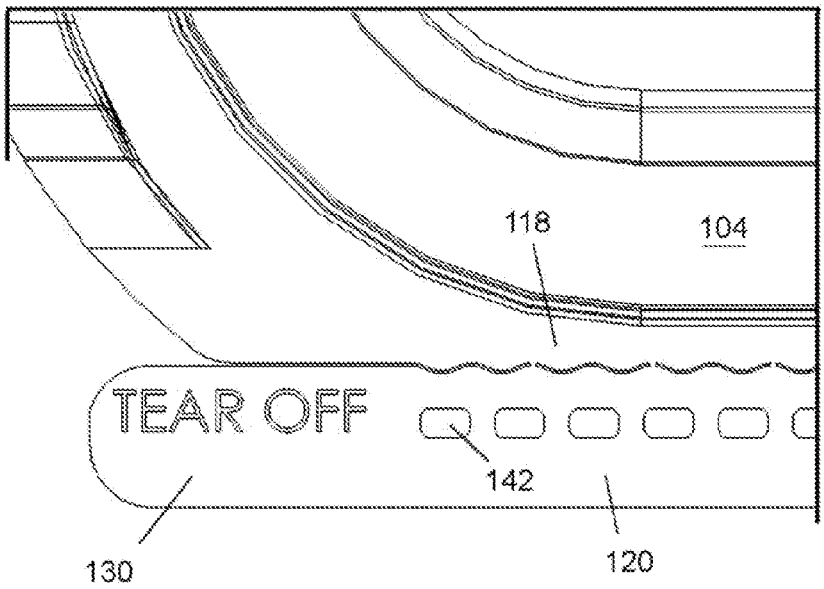
FIG. 4A is a view of a lid tear strip for use with embodiments of containers in accordance with the present invention.
Figure 4B:
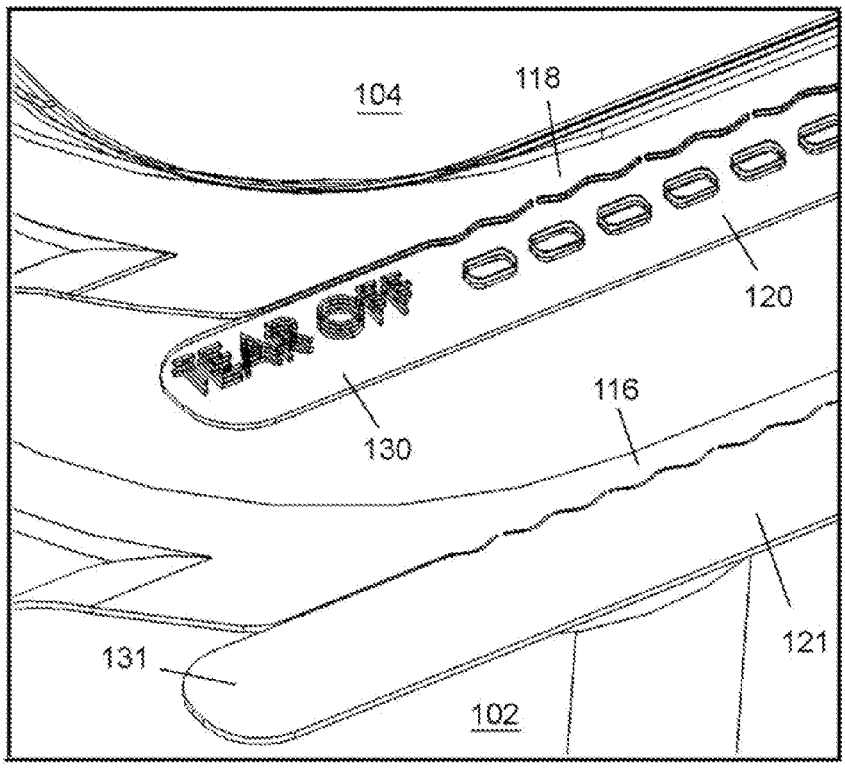
FIG. 4B is a view of a lid tear strip separated from and overlapping a basket tear strip for use with embodiments of containers in accordance with the present invention.
Figure 4C:
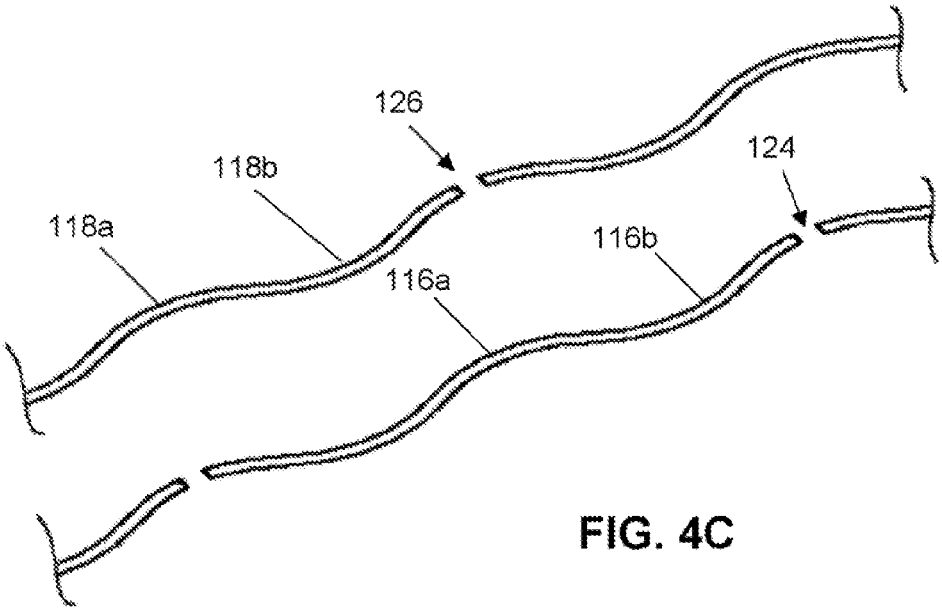
FIG. 4C is a detail view showing the lid and base tear strips connected with the lid lip and basket lip, respectively.
Figure 4D:
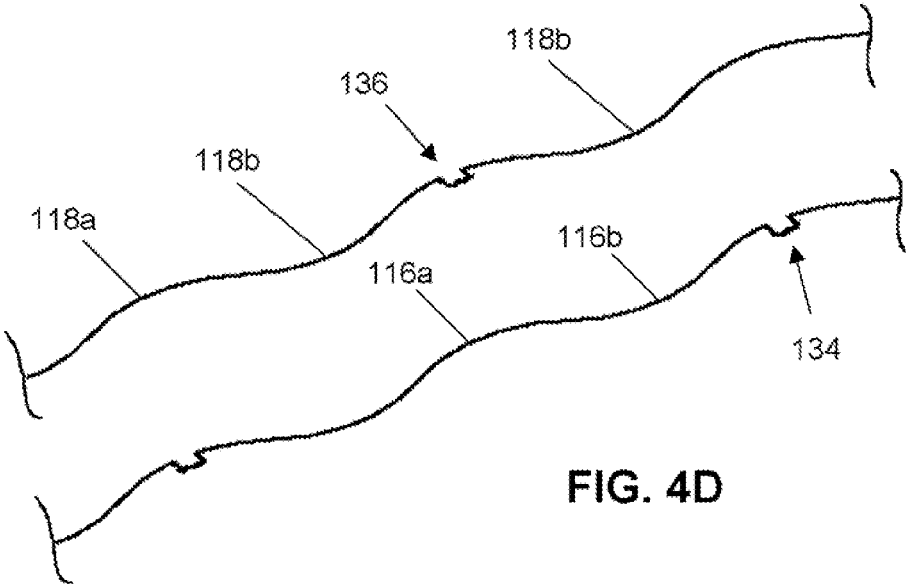
FIG. 4D is a detail view showing the lid and basket tear strips disconnected from the lid lip and basket lip, respectively.

Referring to FIGS. 4C and 4D, the outer surfaces of the lid lip 116 and the basket lip 118 include several features that reduce a force required to detach the tear strips 120, 121 from the basket lip 116 and lid lip 118. The shape of the outer edges of the basket lip 116 and lid lip 118 mirror each other and substantially overlap when the tear strips 120, 121 are bonded together. This arrangement generally aligns disconnected areas between tear strips 120, 118 and lips 116, 118 so that the surfaces do not interfere with each other when the consumer applies force to separate the structures. Further, the basket links 124 are arranged along the outer edge of the basket lip 116 and the lid links 126 are arranged along the outer edge of the lid lip 118 so that the basket links 124 are staggered from the lid links 126. In this arrangement, every other notch 116*a*, 118*a* along an outer edge includes a link 124, 126. The staggered arrangement of links 124, 126 can reduce an amount of force required to detach the bonded tear strips 120, 121 from the lips 116, 118. For example, when the exposed tabs are grasped and the bonded tear strips 120, 121 are pulled upward so that a shear force is applied to the tear strips 120, 121 or pulled outward so that a tensile force is applied to the tear strips 120, 121, the links 124, 126 will detach generally sequentially moving from the grasped tab to the opposite end of the container. The staggered arrangement reduces the amount of force required for the detachment to move from one end of the container to the opposite end.

Figure 4E:
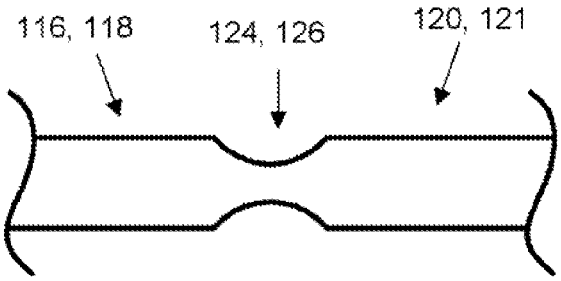
FIG. 4E is a side view of a link connecting a tear strip with a lip.

Referring to the cross-section of FIG. 4E, the links 124, 126 can optionally be kiss-cut so that the links 124, 126 are thinner than the tear strips 120, 121 and lips 116, 118. Kiss-cutting the links 124, 126 reduces the force required for detachment and also encourages the tear strips 120, 121 to detach relatively cleanly along the links 124, 126.

As mentioned previously, the container is filled with goods, the lid is mated with the basket, and the tear strips are bonded together to protect the goods and provide evidence of tamper. Currently perishables such as fruits and vegetables are placed in containers that are formed separately and delivered to a facility for packing. Typically, such containers are clamshell containers that are hinged, and therefore can be opened after the fact so that the basket can be accessed for filling. Embodiments of methods in accordance with the present invention include partially forming a container, packing the container with a perishable good, and completing the container by bonding the lid to the basket.

Figure 5:
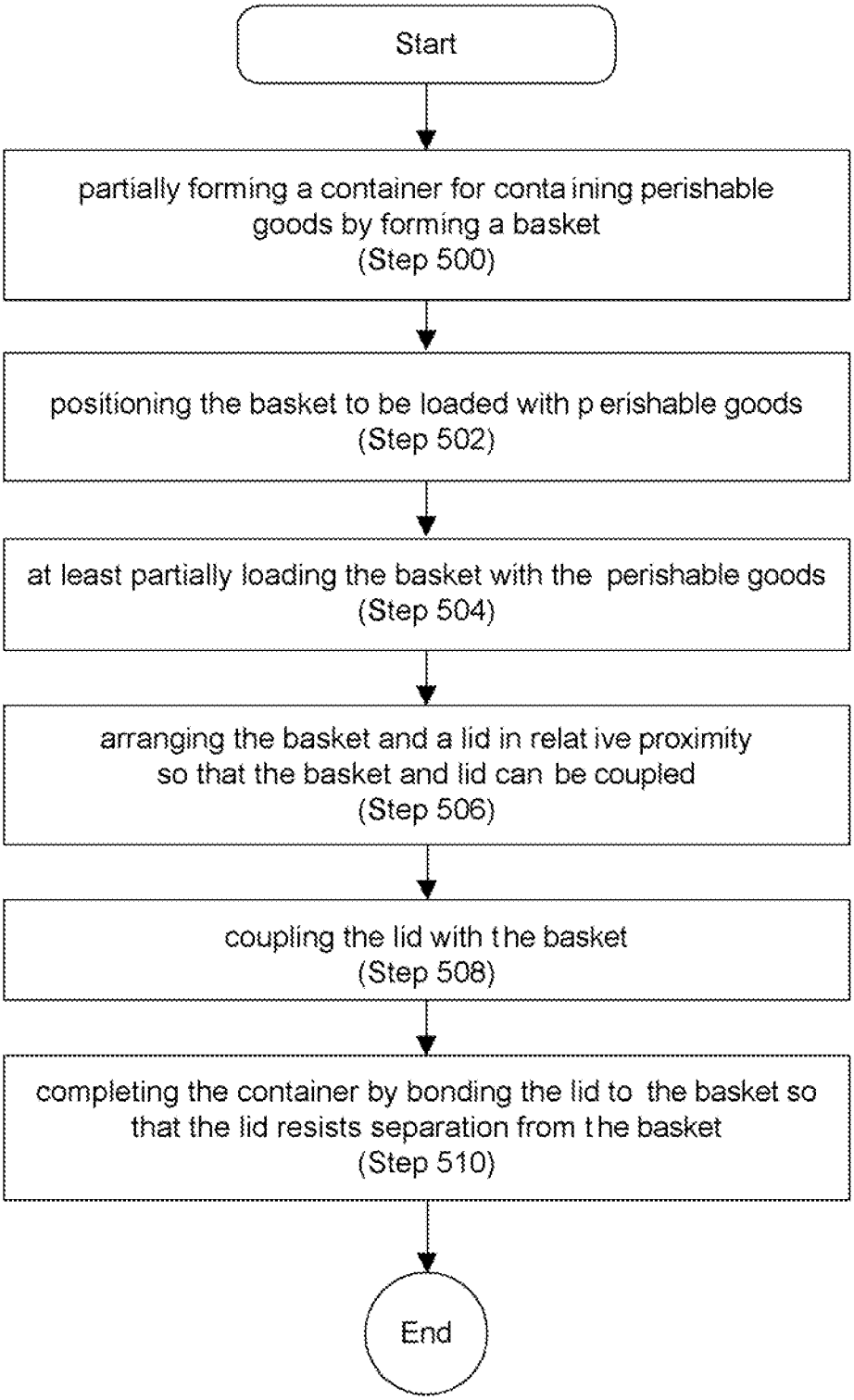
FIG. 5 is a flowchart of a method of packaging perishable goods in a container in accordance with the present invention.

FIG. 5 is a flowchart illustrating a method of packaging perishable goods in a container including a basket and a lid. A container is partially formed for containing perishable goods by forming a basket (Step 500). The basket is positioned to be loaded with perishable goods (Step 502). The basket is then at least partially loaded with the perishable goods (Step 504). The basket and a lid are arranged in relative proximity so that the basket and lid can be coupled (Step 506). The lid is then coupled with the basket (Step 508) and the container is completed by bonding the lid to the basket so that the lid resists separation from the basket (Step 510). Coupling the lid with the basket can include seating the lid on the basket so that complementary features of the lid and basket form an interference fit. In some embodiments, the lid is connected with the basket by a hinge, and coupling the lid with the basket includes pivoting the lid about the hinge to a closed position.

The basket can resemble a basket as described above having a basket lip along at least a portion of a periphery of the basket and a basket tear strip connected along at least a portion of the basket lip. An outer edge of the basket lip can include a plurality of notches and an inner edge of the basket tear strip can have a shape that complements the outer edge of the basket lip. The basket tear strip is connected to the basket lip by a plurality of basket links arranged at notches of the outer edge of the basket lip, with each link extending between a notch and a complementary feature of the inner edge of the basket tear strip.

The lid can have a lid lip along at least a portion of a periphery of the lid and a lid tear strip connected along at least a portion of the lid lip. An outer edge of the lid lip includes a plurality of notches and an inner edge of the lid tear strip has a shape that complements the outer edge of the lid lip, and wherein the lid tear strip is connected to the lid lip by a plurality of lid links arranged at notches of the outer edge of the lid lip, with each link extending between a notch and a complementary feature of the inner edge of the lid tear strip.

The bonded basket tear strip and lid tear strip are detachable from the basket lip and the lid lip when the bonded basket tear strip and the lid tear strip are urged away from the basket and the lid. Detaching the bonded basket tear strip and lid tear strip exposes the outer edge of the basket lip and the outer edge of the lid lip. In an embodiment, the lid tear strip is bonded to the basket tear strip by ultrasonically sealing the lid tear strip to the basket tear strip. As shown in FIG. 4A, ultrasonic sealing can be applied to form welds 142 that bond the tear strips 120, 121 together. However, the tear strips need not be bonded by ultrasonic sealing. For example, in other embodiments the tear strips can be bonded by adhesively sealing the lid tear strip to the basket tear strip. In other embodiments, the tear strips can be bonded by heating the lid tear strip and the basket tear strip so that one or both at least partially melts, and cooling the lid tear strip and basket tear strip.

As mentioned above, the container is preferably formed of at least partially of a transparent or semi-transparent material. In a preferred embodiment, the container can be formed from PETE. However, in other embodiments the container can be formed from any resin known in the art for manufacturing plastic containers. For example, the container can be formed from any of high density polyethylene (HDPE), polyvinyl chloride (PVC), low density polyethylene (LDPE), polypropylene (PP), polystyrene (PS), and polycarbonate. Alternatively, the container can be formed from a material other than plastic resin, for example the container can be formed from paperboard or a composite material such as fiber-reinforced polymer (FRP) or glass-reinforced plastic (GRP).

The foregoing description of the present invention has been presented for purposes of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

The invention claimed is:

1. A container, comprising:

a basket connected with a basket tear strip by basket links along a basket lip having an outer edge comprising an undulating series of rounded protrusions and rounded indentations, the basket links extending from alternating indentations of the outer edge of the basket lip such that no basket links extend from protrusions; and a lid mated with the basket and connected with a lid tear strip by lid links along a lid lip having an outer edge comprising an undulating series of rounded protrusions and rounded indentations, the lid links extending from alternating indentations of the outer edge of the lid lip such that no lid links extend from protrusions;

wherein the lid tear strip is bonded to the basket tear strip to form a seal;

wherein when the lid tear strip is bonded to the basket tear strip, the basket links and lid links are staggered from each other by an indentation so that an applied force necessary to separate the basket tear strip from the basket and the lid tear strip from the lid is determined by an applied force necessary to separate one of a basket link from the basket tear surface and a lid link from the lid tear surface; and wherein when a force applied to the seal separates the basket tear strip from the basket and the lid tear strip from the lid so that the lid is separable from the basket, chaff comprising portions of the basket and lid links are recessed within associated rounded indentations of the basket lip and the lid lip so that no chaff extends from the outer edges of the lid lip and the basket lip beyond adjacent rounded protrusions.

2. The container of claim 1, wherein the bonded basket tear strip and lid tear strip are ultrasonically sealed.

3. The container of claim 1, wherein the basket and lid are removably mateable after separation of the basket tear strip from the basket and the lid tear strip from the lid.

4. The container of claim 1, wherein the basket tear surface and the lid tear surface have substantially the same shape and the round protrusions and rounded indentations of the basket tear surface and the lid tear surface are substantially aligned.

5. The container of claim 1, wherein:

the basket has a base and four side walls, each side wall being configured such that the basket is in an upright position when arranged so that a side wall of the basket is supported by a horizontal surface; and the lid has four edges.

6. The container of claim 5, wherein:

the basket tear strip is a first basket tear strip is connected with the basket along a first wall of the four side walls; and the lid tear strip is a first lid tear strip and is connected with the lid along a first edge of the four edges; and further comprising:

a second basket tear strip connected with the basket along a second wall of the four side walls opposite the first wall; and a second lid tear strip connected with the lid along a second edge of the four edges opposite the first edge;

wherein the second lid tear strip is bonded to the second basket tear strip to form a second seal.

7. A container, comprising:

a basket having a basket lip along at least a portion of a periphery of the basket;

a basket tear strip connected to the basket along at least a portion of the basket lip;

wherein an outer edge of the basket lip has an undulating shape that includes a plurality of rounded protrusions alternating with a plurality of rounded indentations; and wherein an inner edge of the basket tear strip has a shape that complements the outer edge of the basket lip; and wherein the basket tear strip is connected to the basket lip by a plurality of basket links arranged at rounded indentations of the outer edge of the basket lip such that no basket links extend from protrusions of the outer edge of the basket lip, each link extending between a rounded indentation and a complementary feature of the inner edge of the basket tear strips and a lid mated with the basket, the lid having a lid lip along at least a portion of a periphery of the lid; and a lid tear strip connected to the lid along at least a portion of the lid lip;

wherein an outer edge of the lid lip has an undulating shape that includes a plurality of rounded protrusions alternating with a plurality of rounded indentations;

wherein an inner edge of the lid tear strip has a shape that complements the outer edge of the lid lip; and wherein the lid tear strip is connected to the lid lip by a plurality of lid links arranged at rounded indentation of the outer edge of the lid lip such that no lid links extend from protrusions of the outer edge of the lid lip, each link extending between a rounded indentation and a complementary feature of the inner edge of the lid tear strip;

wherein the basket tear strip is bonded to the lid tear strip to resist separation of the lid from the basket;

wherein the bonded basket tear strip and lid tear strip are detachable from the basket lip and the lid lip when the bonded basket tear strip and the lid tear strip are urged away from the basket and the lid;

wherein the basket links are arranged at alternating round indentations of the basket lip;

wherein the lid links are arranged at alternating round indentations of the lid lip;

wherein the basket links and the lid links are offset by one rounded indentation such that the basket links do not overlap the lid links when the basket tear strip is bonded to the lid tear strip, thereby staggering the basket links from the lid links so that an applied force necessary to separate the basket tear strip from the basket lip and the lid tear strip from the lid lip is determined by an applied force necessary to separate a basket link from the basket lip or a lid link from the lid lip;

wherein detaching the bonded basket tear strip and lid tear strip exposes the outer edge of the basket lip and the outer edge of the lid lip; and wherein chaff comprising portions of the basket and lid links resulting from a breaking of the basket and the lid links during detachment of the bonded basket tear strip and lid tear strip are recessed within associated rounded indentations of the basket lip and the lid lip so that no chaff extend from the outer edges of the lid lip and the basket lip beyond adjacent rounded protrusions.

8. The container of claim 7, wherein the indentations in the outer edge of the lid lip are substantially overlapped and aligned with the indentations in the outer edge of the basket lip when the basket tear strip is bonded to the lid tear strip.

9. The container of claim 7, wherein the basket links and the lid links are kiss cut to reduce the applied force necessary to separate the basket tear strip from the basket lip and the lid tear strip from the lid lip.

10. The container of claim 7, wherein the bonded basket tear strip and lid tear strip are ultrasonically sealed.

11. The container of claim 7, wherein the basket and the lid include complementary features for removably mating the lid to the basket; and wherein when the bonded basket tear strip and lid tear strip are detached from the basket and lid, the lid is selectably separable from the basket.

12. The container of claim 11, wherein an interference fit is formed between the basket and the lid at the complementary features when the lid is mated to the basket.

13. The container of claim 7, wherein:

the basket includes a base and four side walls extending between the base and the basket lip;

the lid includes four edges connected with the lid lip; and the basket tear strip is a first basket tear strip and is connected with the basket lip along a first wall of the four side walls;

the lid tear strip is a first lid tear strip and is connected with the lid lip along a first edge of the four edges; and further comprising:

a second basket tear strip connected with the basket lip along a second wall of the four side walls opposite the first wall; and a second lid tear strip connected with the lid lip along a second edge of the four edges opposite the first edge; and wherein the second lid tear strip is bond to the second basket tear strip to resist separation of the lid from the basket.

14. The container of claim 7, wherein the lid is partially connected with the basket by a hinge so that when the basket tear strip and the lid tear strip are separated from the basket and lid, respectively, the basket is accessible by pivotably separating the lid from the basket along the hinge.

15. The container of claim 7, wherein the basket tear strip extends beyond the basket lip and the lid tear strip extends beyond the lid lip to provide a tab for grasping the basket tear strip and the lid tear strip.

16. A container, comprising:

a basket including a basket lip having an outer edge comprising an undulating series of rounded protrusions and rounded indentations, wherein adjacent rounded protrusions are arranged in sufficient proximity so as to be adapted to prevent a finger from entering the rounded indentation;

a basket tear strip including an inner edge having a shape substantially complementing the outer edge of the basket lip and connected to the basket lip by basket links arranged within rounded indentations of the basket lip such that no basket links extend from protrusions of the basket lip; and a lid including a lid lip having an outer edge shaped substantially the same as the basket lip and aligned with the basket lip when the lid is mated with the basket;

a lid tear strip including an inner edge having a shape substantially complementing the outer edge of the lid lip and connected to the lid lip by lid links arranged within rounded indentations of the lid lip such that no lid inks extend from protrusions of the lid lip;

wherein the basket tear strip is bonded to the lid tear strip to form a seal;

wherein the basket links and the lid links are arranged at alternating rounded indentations of the basket lip and the lid lip such that the basket links do not overlap the lid links so that an applied force necessary to separate the basket tear strip from the basket lip and the lid tear strip from the lid lip is determined by an applied force necessary to separate a basket link from the basket lip or a lid link from the lid lip; and wherein when a force applied to the seal separates the basket tear strip from the basket and the lid tear strip from the lid, chaff comprising portions of the basket and lid links is recessed within associated rounded indentations of the basket lip and the lid lip so that no chaff extends from the outer edges of the lid lip and the basket lip beyond adjacent rounded protrusions.

17. The container of claim 16, wherein the basket links and the lid links are kiss cut to reduce the applied force necessary to separate the basket tear strip from the basket lip and the lid tear strip from the lid lip.

18. The container of claim 16, wherein:

the basket includes a base and four side walls extending between the base and the basket lip;

the lid includes four edges connected with the lid lip; and the basket tear strip is a first basket tear strip and is connected with the basket lip along a first wall of the four side walls;

the lid tear strip is a first lid tear strip and is connected with the lid lip along a first edge of the four edges; and further comprising:

a second basket tear strip connected with the basket lip along a second wall of the four side walls opposite the first wall; and a second lid tear strip connected with the lid lip along a second edge of the four edges opposite the first edge; and wherein the second lid tear strip is bond to the second basket tear strip to resist separation of the lid from the basket.

* * * * *

UNITED STATES PATENT AND TRADEMARK OFFICE

CERTIFICATE OF CORRECTION

PATENT NO. : 8,944,270 B2
APPLICATION NO. : 12/885362
DATED : February 3, 2015
INVENTOR(S) : Bontrager et al.

It is certified that error appears in the above-identified patent and that said Letters Patent is hereby corrected as shown below:

On the title page item [75]: after Randall Glenn Strange, Manteca, CA (US), insert --Joseph Michael Torquato, Hollister, CA (US)--.

Signed and Sealed this
Twenty-second Day of March, 2016

Michelle K. Lee

Michelle K. Lee
*Director of the United States Patent and Trademark Office*